United States Patent [19]

Lindquist et al.

[11] Patent Number: 4,931,235

[45] Date of Patent: Jun. 5, 1990

[54] METHOD FOR MAKING STEEL/CONCRETE TANKS

[75] Inventors: Thomas A. Lindquist, Denair; Ralph Bambacigno, Modesto, both of Calif.

[73] Assignee: Convault, Inc., Denair, Calif.

[21] Appl. No.: 319,598

[22] Filed: Mar. 6, 1989

[51] Int. Cl.[5] ..... B28B 1/16

[52] U.S. Cl. ..... 264/40.1; 264/256; 264/273; 264/516; 264/40.3; 249/1; 249/10; 249/93; 249/149; 29/446; 29/454

[58] Field of Search ..... 52/249, 224; 29/446, 29/454; 264/40.3, 40.1, 71, 333, 256, 273, 277, 512, 516; 249/1, 10, 11, 27, 65, 93, 149

[56] References Cited

U.S. PATENT DOCUMENTS

| | | | |
|---|---|---|---|
| 1,555,208 | 2/1923 | Honberger | 427/294 |
| 1,555,209 | 5/1924 | Honberger | 427/294 |
| 1,751,140 | 8/1923 | Field | 427/235 |
| 1,958,487 | 5/1934 | Moran | 52/169.6 X |
| 1,965,646 | 1/1932 | Ihrig | 91/70 |
| 2,083,491 | 6/1937 | Chaffee | 52/192 |
| 2,777,295 | 1/1957 | Bliss et al. | 52/249 X |
| 3,114,970 | 1/1959 | Whitacre | 29/527 |
| 3,130,520 | 4/1964 | Newman, Jr. | 52/138 X |
| 3,151,416 | 10/1964 | Eakin et al. | 264/32 X |
| 3,471,599 | 10/1969 | Archer | 264/255 X |
| 3,511,692 | 5/1970 | Pratt et al. | 117/94 |
| 3,562,977 | 2/1971 | Alleaume | 52/82 |
| 4,013,809 | 3/1977 | Marocco | 427/296 |
| 4,142,705 | 3/1979 | Miller | 249/93 X |
| 4,153,103 | 5/1979 | Bachli | 165/47 |
| 4,183,221 | 1/1980 | Yamamoto | 52/249 X |
| 4,273,811 | 6/1981 | Okamoto et al. | 427/232 |
| 4,366,654 | 1/1983 | Bomhard | 52/249 X |
| 4,372,906 | 2/1983 | del Valle | 264/333 X |
| 4,387,491 | 6/1983 | Schaaf et al. | 52/140 X |
| 4,513,550 | 4/1985 | Kotcharian | 52/249 |

*Primary Examiner*—Timothy V. Eley
*Assistant Examiner*—Frances Chin
*Attorney, Agent, or Firm*—Townsend and Townsend

[57] ABSTRACT

A method for making a steel/concrete tank is provided. A steel interior tank is pressurized during or after pouring of a concrete outer tank around a steel inner tank. Pressurization is commenced before the concrete has set, and is maintained until substantial setting of the concrete. The resulting structure is less susceptible than previous structures to cracking of the exterior concrete upon pressure-testing of the structure for leaks.

8 Claims, 4 Drawing Sheets

METHOD FOR MAKING STEEL/CONCRETE TANKS

The present invention relates to a method for making steel/concrete tanks and, in particular, to a method for making tanks to withstand subsequent pressure testing.

BACKGROUND OF THE INVENTION

A number of methods are known for making a metal tank which is fully or partially encased in a cement coating or outer tank. In some such methods, concrete is directly applied to the metal tank and cured or set. Such a method has been found to produce a structure which is susceptible to cracking during subsequent testing procedures and use.

SUMMARY OF THE INVENTION

In tanks which are intended to hold fluids, the tank is often tested for leaks by pressurizing the tank, such as pressurizing with air, and determining whether the tank holds or maintains the pressure. However, even when the inner tank is made of a relatively rigid material, e.g., steel, some amount of tank expansion occurs from the pressurization, analogous to blowing up a balloon. When the inner tank is encased in a relatively brittle material, e.g., concrete, the concrete can crack or otherwise fail when the inner tank tends to expand under the influence of pressure. Accordingly, it would be advantageous to provide a method for making a steel/concrete tank which can be pressure-tested with a decreased susceptibility to cracking of the concrete.

The present invention includes pressurizing the interior tank to a pressure greater than the pressure exterior of the tank, preferably a superatmospheric pressure, during or after pouring of the concrete, but before the concrete has set. Such a method is effective for reducing the susceptibility of the resulting structure to failure during subsequent pressure testing. Without wishing to be bound by theory, it is believed that after the concrete has set and the interior tank pressure has been reduced, the pressure-expanded tank returns to its normal size to create a small space or gap between the set concrete wall and the tank. Preferably, creation of this gap is aided by use of an intermediate layer, such as a sheet of plastic, between the steel tank and the newly-poured concrete.

The structure according to the present invention is also less susceptible to cracking from other causes, such as differential thermal expansion, or other interior-tank expansion which might arise during use.

DETAILED DESCRIPTION OF THE PREFERRED EMBODIMENT

Figure 1:
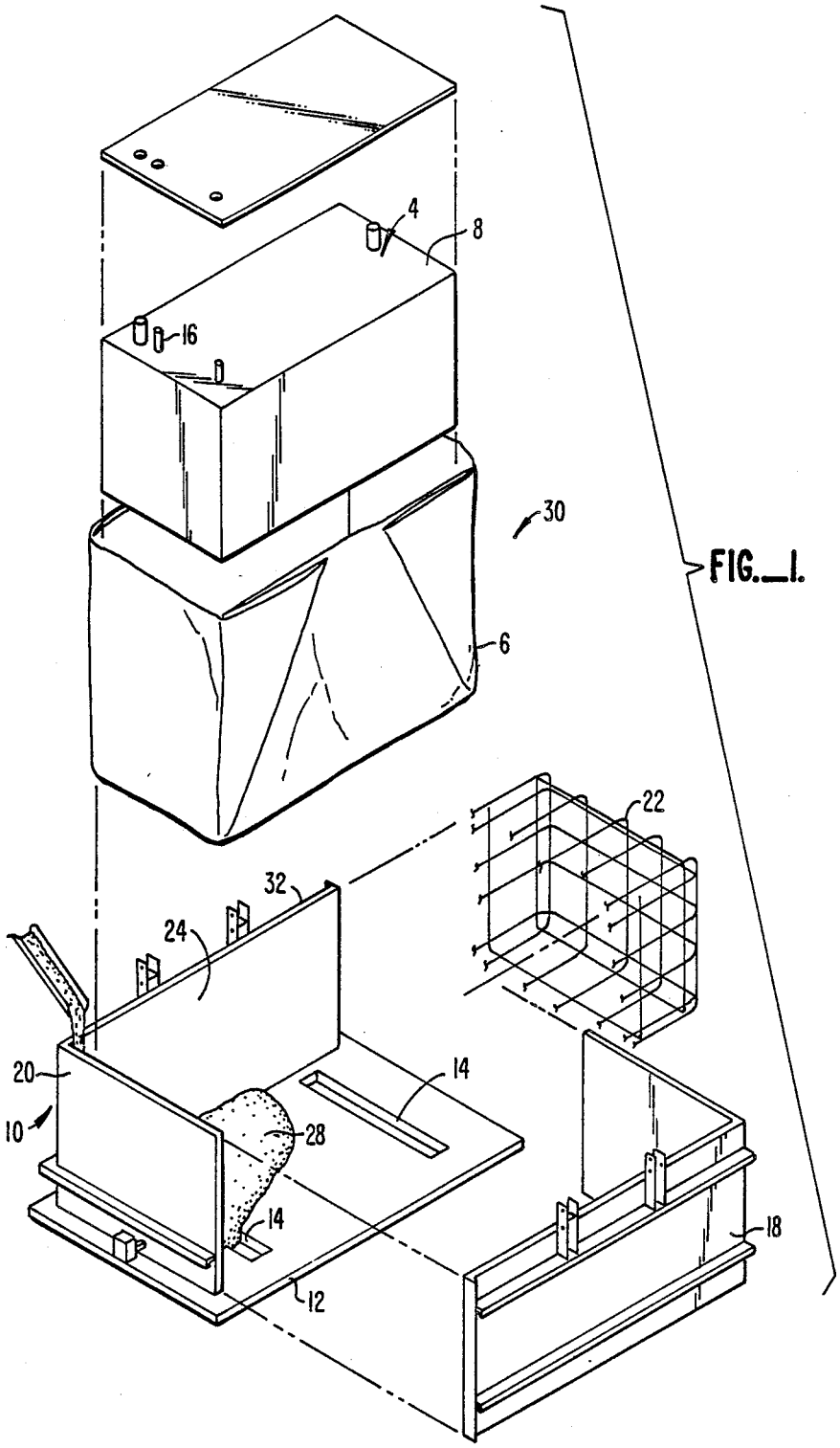
FIG. 1 is an exploded perspective view of a tank in a mold being filled with concrete.

Referring now to FIG. 1, an appropriate inner tank 4 is provided. Preferably, the inner tank 4 is steel tank. Optionally, a sheet 6 of liquid-impervious material, such as polyethylene film, is wrapped around the tank 4 and gathered over the top 8 of the tank 4 to create a second liquid barrier.

Figure 2:
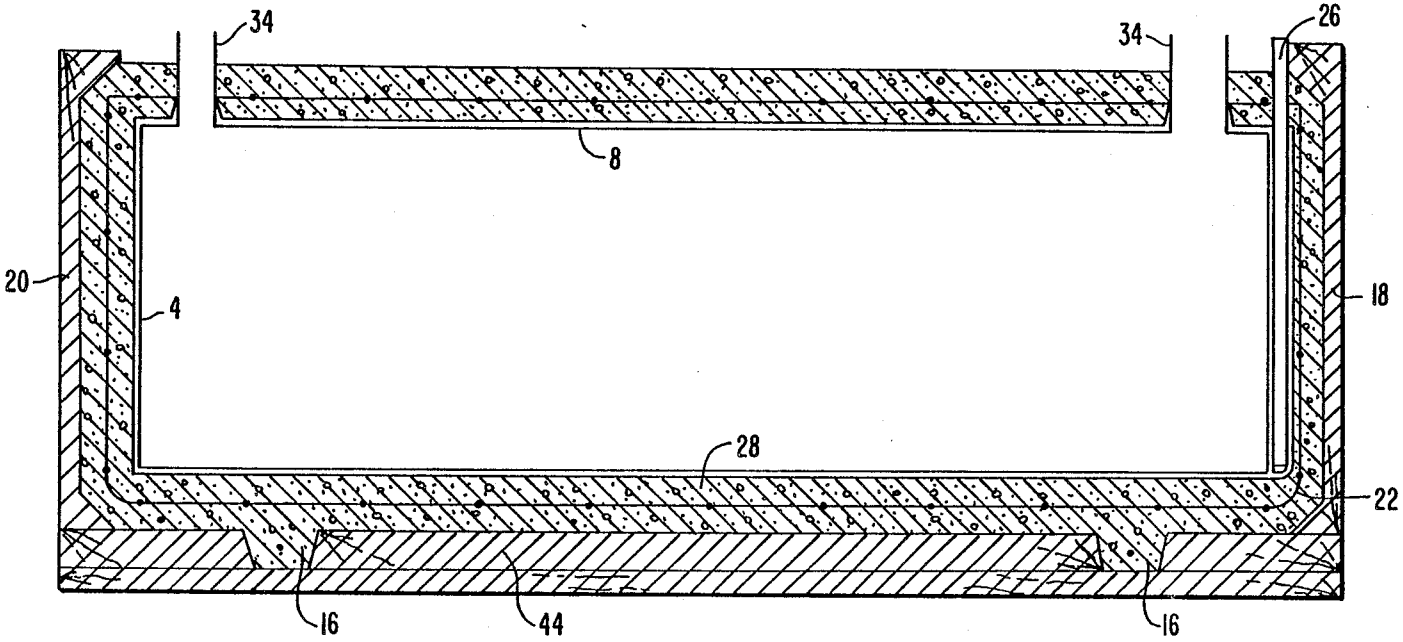
FIG. 2 is a cross-sectional view of a pressurized tank in a mold after pouring of concrete.

A concrete form assembly 10 is used in entombing the inner tank 4, liner 6 combination. The form assembly 10 includes a baseplate 12, preferably having a pair of openings 14 used to form bottom supports 16 (best seen in FIG. 2), and two L-shaped wall forms 18, 20. The wall forms 18, 20 constitute a sidewall form. After assembly of the baseplate 12 and the wall forms 18, 20, a wire mesh or rebar cage 22 is placed within an enclosure 24 defined by the wall forms 18, 20 and the baseplate 12. Optionally, a leak detector pipe 26 of conventional design is positioned adjacent to the inner tank 4 to permit the user to monitor for leaks between inner tank 4 and liner 6. A layer 28 of concrete is poured within the enclosure 24 to cover the baseplate 12. The combination 30 of the inner tank 4, and the sheet 6 is then positioned within the enclosure 24 on top of the still-wet layer 28 of concrete. Additional concrete is then placed within the region between the combination 30 and the wall forms 18, 20, sufficient to cover the combination 30 and be generally level with the top edge 32 of the sidewall form.

When it is desired to prevent the pressurized tank 4 from floating or bobbing in the still-unset concrete, the buoyant tendency of the tank is offset. According to a nonpreferred method, the tank can be filled with a liquid to offset the buoyant tendency. However, such a method leads to contamination of the tank, since it is difficult to completely remove the liquid. Therefore, it is preferable to provide an apparatus for holding or clamping the tank in the preferred submerged position, as described, for example, in Applicant's co-pending application Ser. No. 118,918.

Preferably, each hold-down assembly 42A, 42B includes an elongate hold-down bar 44 having camfered ends 46 guided between vertical guide plates 48. The guide plates 48 are mounted to the wall forms 20 and extend above the top edge 32. The hold-down bar 44 has a pair of downwardly extending hold-down tubes 52 depending from its bottom surface 54, and a strong back 56 mounted centrally above the top surface 58 of the hold-down bar 44. The strong back 56 has an arcuate guide surface 62 and a pair of vertical guide plates 64. The hold-down assembly 42A includes a chain 66 having each end 68 secured to an anchor point 72 on a jack block 74. The chain 66 passes from the jack block 74 on one side of the form assembly 10, between the vertical guides 48, across the camfered ends 46, over the curved surface 62 of the strong back 56, and down past the camfered ends of the hold-down bar 44 on the other side. The hold-down assembly 42A also includes a chain ratchet 76. The chain ratchet 76 is used to shorten the effective length of the chain 66, thus forcing the tubes 52 against the top 8 of the inner tank 4.

The steel tank is pressurized either during or shortly after pouring of the concrete 28, but, in any case, pressurization of the inner tank 4 is accomplished before the concrete is set or rigidified. Pressurization of the tank 4 can be by any well-known means, and is preferably achieved by providing air pressure to the interior of the tank 4 through a fill and/or vent pipe 34 which communicates with the interior of the tank 4. Pressurization is maintained preferably at least about 5 lbs./in.$^2$ (about 0.035 MPa) up to 10 lbs./in.$^2$ (about 0.07 MPa) or more. As the concrete is poured and is set, the pressurization of the inner tank creates an expansion of the tank, which is depicted in its expanded configuration in FIG. 2.

Figure 3:
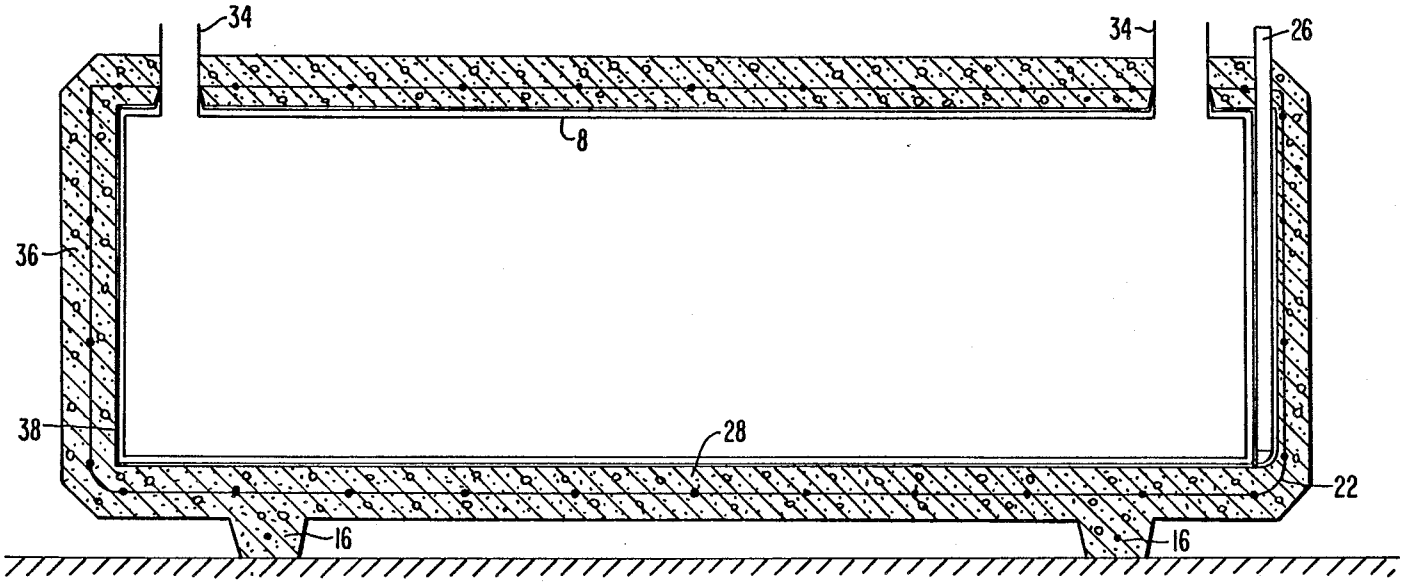
FIG. 3 shows a steel/concrete tank, according to the present invention, at atmospheric pressure.
Figure 4:
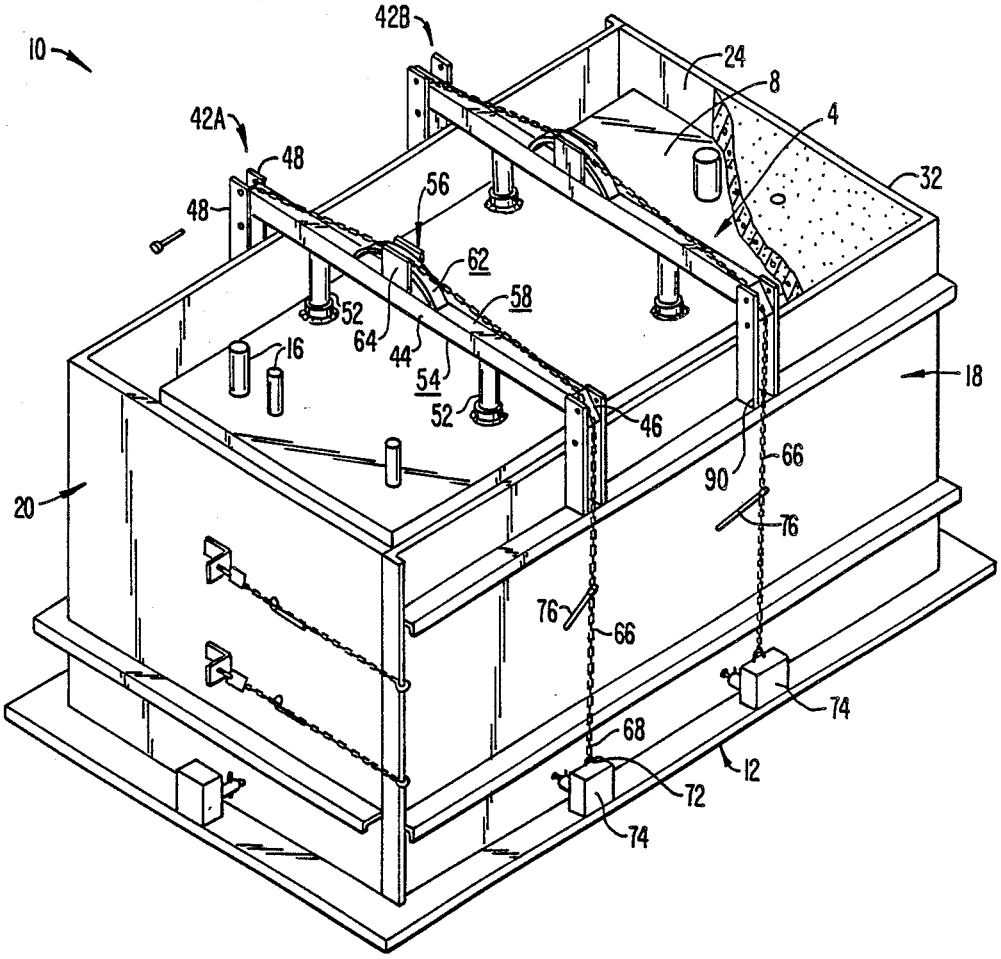
FIG. 4 shows the inner tank within the form assembly and a hold-down apparatus.

After the concrete has set, forming an outer tank 36, the pressurization of the tank 4 is reduced or removed so that it is, preferably, returned to about atmospheric pressure. Because of the removal of this pressure, the tank 4 shrinks back from its expanded state to the atmospheric-pressure state, as depicted in FIG. 3. Because of such shrinkage, it is believed that a small space or gap 38 is formed between the inner tank 4 and the concrete outer tank 36. This space or gap 38 forms an internal expansion region for the steel tank 4. When the completed steel/concrete tank structure, depicted in FIG. 3, is subsequently pressure-tested, the expansion of the inner tank 4, which results from the pressure testing, is accommodated by the space or gap 38 previously formed.

As will be apparent to those skilled in the art, a number of modifications and variations of the invention can also be used. The tank 4 can be made of other materials, including aluminum and plastic. Although, in a preferred embodiment, a rebar cage and polyethylene sheet are provided, it is possible to form a steel/concrete tank by placing concrete directly adjacent to the tank 4. If so, a liquid mold release may be used on the outside of tank 4. Other shapes of tanks and molds or forms can be provided.

Although the description of the invention has included a description of a preferred embodiment and modifications and variations, other modifications and variations of the invention can also be used, the invention being defined by the appended claims.

What is claimed is:

1. A method for making a tank encased in concrete, comprising:

supporting said tank within a form structure to define a space between the tank and the form structure;

pouring a settable concrete in said space;

pressuring the interior of said tank to a superambient pressure at least during a time period before said settable concrete has substantially set, so as to expand said tank;

substantially maintaining said tank in pressurized state until said settable concrete has set; and reducing said pressure in the interior of said tank to establish a space between said set concrete and said tank.

2. A method, as claimed in claim 1, further comprising enveloping said tank in a sheet of liquid-impervious material.

3. The method of claim 1, further comprising the step of providing a release material between said tank and the settable concrete to prevent the concrete from adhering to the tank.

4. A method, as claimed in claim 1, wherein said superambient pressure is at least about 5 lbs./in.$^2$.

5. A method, as claimed in claim 1, further comprising:

testing said encased tank by pressurizing said tank at a second superambient pressure.

6. A method for making a tank embedded in concrete, comprising:

providing a substantially gas-tight metal tank;

enveloping said tank in a sheet of liquid-impervious material;

positioning said enveloped tank within a mold to define a space between the tank and the mold;

positioning a settable concrete in said space;

pressurizing the interior of said tank to a pressure greater than the pressure exterior of the tank at least during a time period before said concrete has set, so the tank expands;

substantially maintaining said pressure in the interior of said tank at least until said settable concrete has substantially set; and reducing the pressure in the interior of said tank after the concrete has substantially set to establish a space between said set concrete and said tank.

7. A method for embedding a tank in concrete, comprising:

supporting the tank within a form structure to define a space between the tank and the form structure;

pouring a settable concrete in said space;

pressurizing the interior of said tank at a superambient pressure at least during a time period before said settable concrete has set; and substantially maintaining said superambient pressure in said tank until said settable concrete has substantially set.

8. A method for embedding a tank in settable concrete, comprising:

providing a tank which has buoyancy with respect to said settable concrete;

supporting the tank within a form structure to define a space between the tank and the form structure;

pouring said settable concrete in said space;

filling the tank with a liquid at least to a level sufficient to offset said buoyancy of the tank with respect to said concrete before said concrete has set; and permitting said settable concrete to set.

* * * * *